US011008751B2

(12) United States Patent
Dratschmidt et al.

(10) Patent No.: US 11,008,751 B2
(45) Date of Patent: May 18, 2021

(54) SYSTEM FOR FASTENING ATTACHMENTS TO A SUBSTRATE WITH AN INSULATION LAYER

(71) Applicant: EJOT Baubefestigungen GmbH, Bad Laasphe (DE)

(72) Inventors: Frank Dratschmidt, Bad Berleburg (DE); Rene Achenbach, Bad Laasphe (DE); Wolfgang Schaefer, Bad Laasphe (DE)

(73) Assignee: EJOT Baubefestigungen GmbH, Bad Laasphe (DE)

( * ) Notice: Subject to any disclaimer, the term of this patent is extended or adjusted under 35 U.S.C. 154(b) by 183 days.

(21) Appl. No.: 16/309,017

(22) PCT Filed: Jun. 8, 2017

(86) PCT No.: PCT/EP2017/063962
§ 371 (c)(1),
(2) Date: Dec. 11, 2018

(87) PCT Pub. No.: WO2017/216032
PCT Pub. Date: Dec. 21, 2017

(65) Prior Publication Data

US 2020/0308827 A1 Oct. 1, 2020

(30) Foreign Application Priority Data

Jun. 16, 2016 (EP) ..... 16174736
Aug. 10, 2016 (EP) ..... 16183561

(51) Int. Cl.
*E04B 1/76* (2006.01)
*E05D 5/02* (2006.01)

(52) U.S. Cl.
CPC ..... *E04B 1/7637* (2013.01); *E04B 1/7633* (2013.01); *E05D 2005/0292* (2013.01); *E05Y 2800/674* (2013.01); *E05Y 2800/676* (2013.01)

(58) Field of Classification Search
CPC ..... E04B 2/02; E04B 1/762; E04B 1/7633; E04B 1/4178; E04B 1/76; F16B 19/02; F16B 43/001
See application file for complete search history.

(56) References Cited

U.S. PATENT DOCUMENTS 3,523,395 A * 8/1970 Konrad ..... F16B 37/145 52/410
5,054,983 A * 10/1991 Froewis ..... F16B 43/00 411/480

(Continued)

FOREIGN PATENT DOCUMENTS

CA 2775233 A1 * 12/2012 ..... E04B 1/4178
DE 10 2008 004753 A1 7/2009
EP 1982797 A2 * 10/2008 ..... E04D 15/04

OTHER PUBLICATIONS

Extended European Search Report dated Aug. 14, 2017.

(Continued)

*Primary Examiner* — Jessie T Fonseca
(74) *Attorney, Agent, or Firm* — Wood, Phillips, Katz, Clark & Mortimer

(57) ABSTRACT

Fastening system (1) for fastening an attachment (18) to a substrate (13) with an insulation layer (16), the fastening system (1) comprising an anchor bolt (2), with a first area (3) for anchoring in the substrate (13), a second area (4) to which the attachment (18) can be fastened, and a stop (5), a mounting tool (6) to form an opening in the insulation layer (16), and a sealing element (7) adapted to be disposed at the (Continued)

stop (5) after the mounting tool (6) has been removed and to seal the opening in the insulation layer (16) as well as a corresponding method.

8 Claims, 2 Drawing Sheets

(56) References Cited

U.S. PATENT DOCUMENTS

| | | | | | |
|---|---|---|---|---|---|
| 5,171,118 | A * | 12/1992 | Rothenbuhler | E04B 1/762 | 411/480 |
| 5,426,905 | A * | 6/1995 | Rollhauser | A62C 2/06 | 411/396 |
| 5,660,015 | A * | 8/1997 | Kluser | E04B 1/7629 | 411/392 |
| 5,671,576 | A * | 9/1997 | Kluser | E04B 1/7633 | 411/383 |
| 6,709,214 | B1 * | 3/2004 | Angehrn | E04D 3/3603 | 411/533 |
| 9,551,157 | B2 * | 1/2017 | Koelner | E04B 1/7633 | |
| 9,551,369 | B2 * | 1/2017 | Koelner | E04B 1/76 | |
| 2005/0055927 | A1 * | 3/2005 | Tiemann | F16B 13/00 | 52/459 |

OTHER PUBLICATIONS

International Preliminary Report on Patentability dated Dec. 20, 2018.

International Search Report, dated Aug. 14, 2017, in International Patent Application No. PCT/EP2017/063962.

* cited by examiner

Fig. 1a
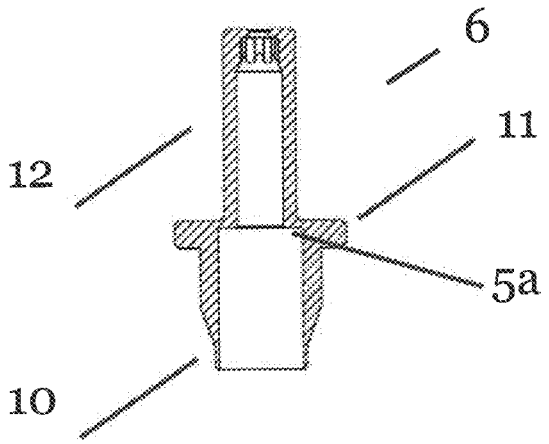
Fig. 1b
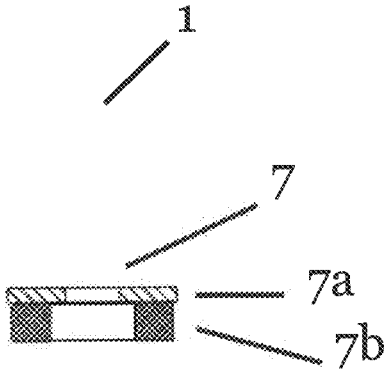
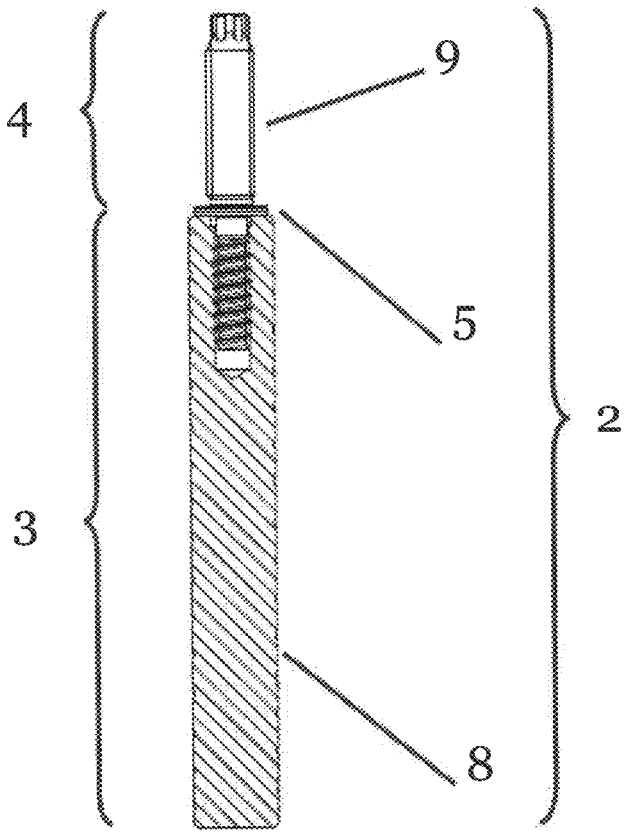
Fig. 1c

SYSTEM FOR FASTENING ATTACHMENTS TO A SUBSTRATE WITH AN INSULATION LAYER

FIELD OF THE INVENTION

This invention relates a system for fastening attachments to a substrate with an insulation layer and a corresponding method.

BACKGROUND OF THE INVENTION

Insulation layers are applied to exterior walls to improve the insulation of houses. This, however, makes it more difficult to fasten heavy attachments to the outer walls, as the fasteners for heavy attachments cannot be attached to the insulation layer itself, but only to the substrate behind or below it, so that the attachments are at a certain distance from the supporting substrate. Such a fastening system is described in DE to 2008 004 753 A1.

Attachments, such as canopies, have to withstand different loads. If there is snow on a canopy, it becomes heavier and therefore it is pushed downwards, while a gust of wind can push the canopy upwards. This causes the insulation layer around the fastener to widen, making the insulation layer in this area unsightly and allowing moisture to penetrate into the insulation layer.

The object of this invention is therefore to provide a fastening system and a method for fastening attachments to a substrate where the disadvantage described above does not occur.

BRIEF SUMMARY OF THE INVENTION

According to the invention, the object is solved by a fastening system for fastening an attachment to a substrate with an insulation layer. The fastening system comprises an anchor bolt, a mounting tool and a sealing element. The anchor bolt comprises a first area for anchoring in the substrate, a second area to which the attachment can be fastened, and a stop. The mounting tool is configured to form an opening in the insulation layer. The sealing element is adapted to be disposed at the stop after the mounting tool has been removed and to seal the opening in the insulation layer. In the context of this invention, the insulation layer may consist of one or more layers. The insulation layer can, for example, consist of one or more layers of insulation material and, if necessary, of a plaster layer arranged on top of it.

With the fastening system according to the invention, an attachment can be fastened in the best possible way to a substrate with an insulation layer. By means of the mounting tool, an opening around the anchor bolt in the insulation layer is formed. Due to the defined removal or expansion of the insulation layer in a ring around the anchor bolt and due to the subsequent removal of the mounting tool, the anchor bolt is given a free space in which it can move without affecting the insulation layer. This free space created in this way is preferably arranged concentrically around the anchor bolt so that the anchor bolt can move in all directions or a deformation of the anchor bolt without constraint is possible.

After removing the mounting tool, the sealing element is placed at the stop of the anchor bolt to seal the opening in the insulation layer. The sealing element is preferably ring-shaped and has a radial extension which extends beyond the opening in the insulation layer. It extends parallel to the outer surface of the insulation layer and, as is usual with sealings, preferably has a flexible material.

The fastening system according to the invention allows a long-term, beautiful and tight installation of an attachment with simple means. The mounting tool ensures that a predefined free space is formed around the anchor bolt in which the anchor bolt can move or deform in response to external forces without this having any effect on the insulation layer and/or a plaster layer applied to it. This is particularly the case because the mounting tool is removed again after the opening or free space has been formed. Until then, however, the mounting tool keeps the anchor bolt centered in the free space and thus ensures that, for example, if the anchor bolt is fixed with an adhesive, the anchor bolt cannot move during curing of the adhesive. This can be, for example, the setting process of a composite anchor mortar. The mounting tool and/or the anchor bolt preferably have means which ensure that the mounting tool and the anchor bolt are radially fixed during curing of the adhesive. According to the invention, the anchor bolt is aligned radially with the aid of the mounting tool, especially in the formed free space.

The sealing element can then be placed on the side of the insulation layer facing away from the substrate, which is also referred to as the outer side or outer surface of the insulation layer, and at the stop of the anchor bolt, thus sealing the opening from the outside. This means that if the anchor bolt moves due to external forces, the sealing element will not damage the insulation layer and will continue to seal the opening.

In a preferred embodiment, the anchor bolt consists of two elements, a plastic rod that forms the first area and a metal rod that forms the second area. Preferably, the metal rod has a thread with which it can be screwed into an opening in the plastic rod. But the person skilled in the art is aware that there are many possibilities to connect the two elements of the anchor bolt. A glass fibre reinforced plastic is preferably used for the plastic rod and stainless steel is preferably used for the metal bolt. In a preferred embodiment, the plastic rod has a profile on its outside, for example in the form of a thread. Such a thread can lead to a better hold in the substrate and/or in the insulation layer. In particular, the external thread can be used to create a bonding effect with the adhesive, for example the composite anchor mortar.

EPDM rubber is preferably used for the sealing element. The sealing element can have two sealing levels. One sealing level is formed between the sealing element and the outer side of the insulation layer, the other sealing level between the sealing element and the anchor bolt, in particular the second area of the anchor bolt. The sealing element preferably consists of a sealing member, for example a sealing ring made of EPDM rubber and a washer made of stainless steel. The sealing member is preferably configured in such a way that in case of a relative displacement of the anchor bolt under service load it compensates, due to its configuration, this relative displacement without loss of the sealing function. The washer of the sealing element can preferably be configured in such a way that it can be used as a stop and/or as a support surface for the attachment.

In a preferred embodiment of the anchor bolt, the second area has means to fasten the attachment to it. Preferably this is an external thread. In addition, the anchor bolt is preferably configured in such a way that at least part of it protrudes from the insulation layer when installed. Preferably a part of the second area of the anchor bolt protrudes from the insulation layer in order to be able to fasten an attachment to it. In principle, however, the anchor bolt can also have an opening into which, for example, a fastening element can be screwed, with which the attachment is fastened to the anchor bolt.

The mounting tool preferably has at least one means which, when the mounting tool is rotated into the insulation layer, remove the insulation layer in a predefined area around the anchor bolt. These are preferably one or more elements which protrude radially from the mounting tool and which remove material from the insulation layer during rotating. In addition, the mounting tool preferably has means which enable or simplify the rotary insertion of the mounting tool. This is preferably an external hexagon.

In accordance with a preferred embodiment, the mounting tool is arranged on the anchor bolt in such a way that movement of the mounting tool into the borehole in the direction of the substrate also leads to movement of the anchor bolt in the direction of the substrate. This can be achieved, for example, by the mounting tool having a counter stop which rests against the stop of the anchor bolt. However, the person skilled in the art also knows other possibilities to make this movement possible.

Preferably, the mounting tool has at least one projection. This projection is preferably configured in such a way that it can rest on the outer surface of the insulation layer. The projection allows the mounting tool to be positioned up to a predetermined depth into the insulation layer, that is until the projection rests on the outer side of the insulation layer. While the mounting tool is moved in the direction of the insulation layer and possibly at least partially into the insulation layer until the projection lies on the outer side of the insulation layer, the counter stop of the mounting tool, for example, ensures that the stop of the anchor bolt and thus also the anchor bolt is moved into a predetermined axial position relative to the surface of the insulation layer. Since the sealing element, in a preferred embodiment, in the installed state rests partly on the outer surface of the insulation layer and partly on the stop of the anchor bolt, the axial position of the sealing element can be defined by the position of the projection of the mounting tool relative to the counter stop of the mounting tool.

The sealing element is preferably configured in such a way that, when installed, the washer rests on the stop of the anchor bolt and the sealing member on the outer surface of the insulation layer. This makes it possible to define the compression path of the sealing element, in particular the sealing member, through the position of the projection relative to the counter stop on the mounting tool.

In order for the sealing element to be able to seal the opening in the insulation layer, it is larger than the opening parallel to the extension of the insulation layer, that is to essentially at right angle to the borehole. If it is installed at the stop of the anchor bolt, it lies on the side of the insulation layer facing away from the substrate. Preferably, however, the sealing element is much larger than the opening. The opening formed by the mounting tool is preferably substantially circular and has a radius which depends on the configuration of the mounting tool. Since the anchor bolt is located in the opening, which in a preferred embodiment has a substantially circular cross-section, the free space between the insulation layer and the anchor bolt has the shape of a circular ring. Preferably, at this circular ring, the distance between the anchor bolt and the insulation layer is essentially the same in all directions. This distance is also called the thickness of the free space. In a preferred embodiment, the sealing element is large enough to cover a circular area with a radius equal to the sum of the radius of the opening and the thickness of the free space.

In accordance with the invention, the object is also solved by a method for fastening an attachment to a substrate with an insulation layer. The method comprises inserting an anchor bolt into an opening in the insulation layer and in the substrate. In addition, a mounting tool is arranged on an anchor bolt. The arrangement preferably takes place before the insertion. However, it can also take place during insertion or after insertion of the anchor bolt. Accordingly, the mounting tool should preferably be inserted into the insulation layer at the same time as the anchor bolt. The mounting tool forms an opening in the insulation layer. Subsequently, the mounting tool is removed and a sealing element is placed at a stop of the anchor bolt to seal the opening in the insulation layer.

In the following, the present invention is described by way of example using an embodiment which is illustrated in the following figures, whereby

BRIEF DESCRIPTION OF THE DRAWINGS

FIGS. 1*a*-1*c* (collectively referred to as FIG. 1 herein) show cross-sections through components of an embodiment of the fastening system according to the invention.

DETAILED DESCRIPTION OF THE INVENTION

Figures 2A, 2B, 2C, 2D, 2E:
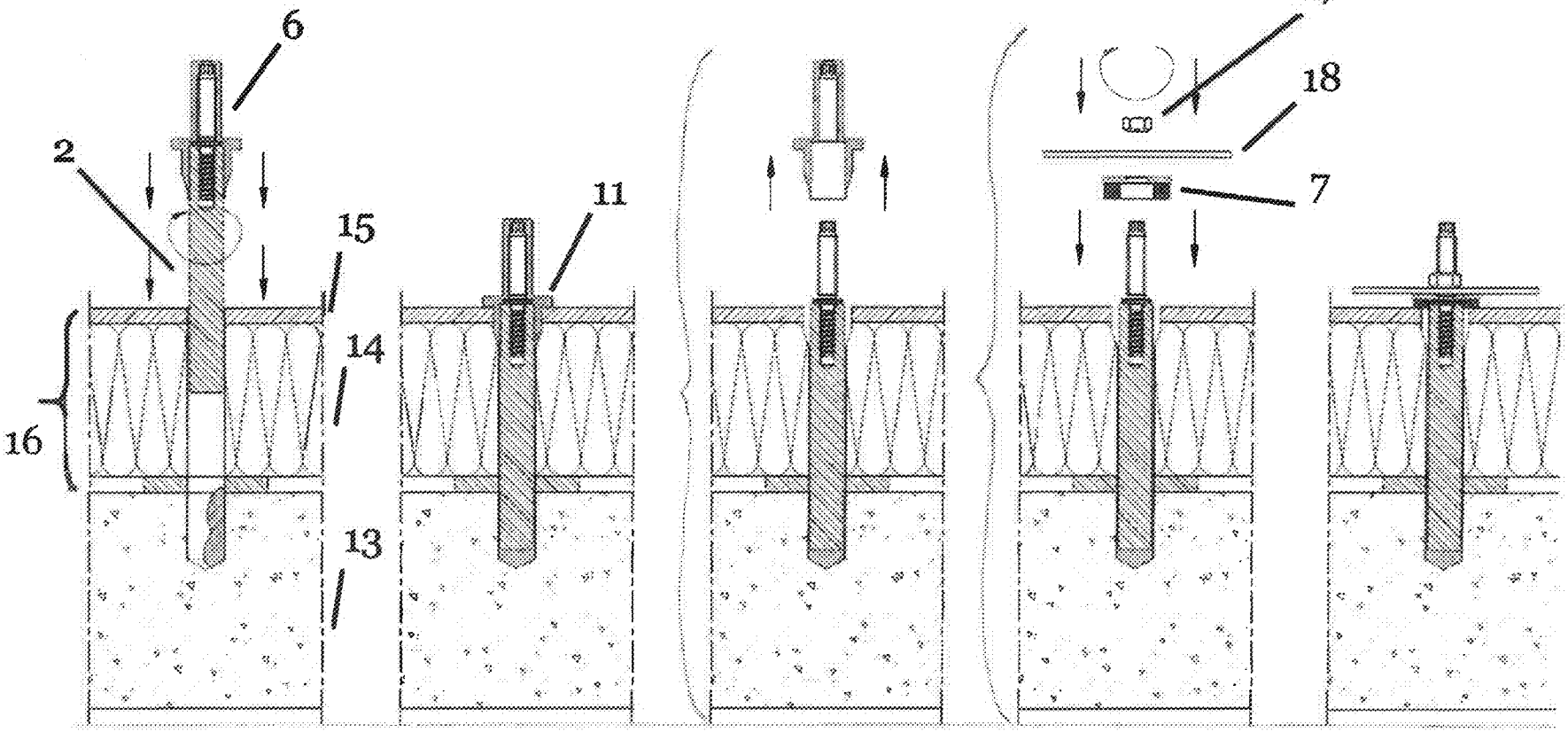
FIGS. 2*a*-2*e* show an example of the installation of the embodiment shown

FIG. 1 shows an exemplary embodiment of the fastening system 1 according to the invention. This fastening system 1 has at least three elements, an anchor bolt 2, a mounting tool 6 and a sealing element 7.

According to the invention, the anchor bolt 2 has two areas. A first area 3 provides the anchoring in a substrate. In the embodiment shown in FIG. 1, this first area 3 is formed by a plastic rod 8. This plastic rod 8 is pushed into a borehole in which, for example, an adhesive is located and with the adhesive the plastic rod 8 and thus the entire fastening system 1 is anchored in the borehole. The anchor bolt 2 also has a second area 4 to which an attachment can be fastened. In the embodiment shown in FIG. 1, the second area 4 is formed by a metal bolt 9. In this embodiment, the metal bolt 9 has an external thread, to which the attachment can be fastened with the aid of a nut, for example. In addition, the external thread can also be used to attach the sealing element 7 to the metal bolt 9. The plastic rod 8 and the metal bolt 9 can be arranged together in many different ways. This connection, for example, can be established on the construction site. Preferably, however, the plastic rod and the metal bolt are already connected to each other at the factory. In the embodiment shown in FIG. 1, the metal bolt 9 has a further external thread which is screwed into an opening in the plastic rod 8. However, the person skilled in the art is also aware of other ways of firmly connecting these two elements.

The anchor bolt 2 also has a stop 5. In the embodiment shown in FIG. 1, the stop 5 is formed by the fact that the first area 3 and the second area 4 have different diameters. But the person skilled in the art also knows other means to make a stop 5 at the anchor bolt 2. This stop 5 does not necessarily have to be arranged at the transition from the first area 3 to the second area 4 as in FIG. 1. The stop can also be located in the first area 3 or in the second area 4.

The mounting tool 6 of the fastening system 1 according to the invention is configured to form an opening in an insulation layer. It preferably has means to which remove the insulation layer, for example a plaster layer and partly a layer of insulation material around the anchor bolt 2, when the mounting tool 6 is rotated. Preferably, the mounting tool 6 is used to remove material from the insulation layer so that there is a permanent opening. The opening thus formed preferably extends annularly around the anchor bolt 2 arranged in the insulation layer. In the embodiment of the fastening system 1 shown in FIG. 1, the mounting tool 6 also has a projection 11, which is configured in such a way that it can rest on the side of the insulation layer facing away from the substrate. In the present embodiment, the projection 11 is circular in shape and extends from the mounting tool 6 in all directions. However, the person skilled in the art is also aware of other configurations for a suitable projection 11.

In the embodiment shown in FIG. 1, the mounting tool 6 can be arranged in a predefined position relative to the anchor bolt 2. For example, the mounting tool 6 is configured in such a way that a counter stop 5*a* of the mounting tool 6 can be arranged at the stop 5 of the anchor bolt 2. In addition or alternatively, the mounting tool 6 may also be configured to engage the end of the second area 4 of the anchor bolt 2, which is spaced from the first area 3. This engaging ensures that a rotary movement of the mounting tool 6 is transmitted to the anchor bolt 2. For this purpose, the mounting tool 6 and the anchor bolt 2 may have corresponding recesses and projections.

During installation, for example, the anchor bolt 2 can be arranged together with the mounting tool 6 arranged on it in a borehole in the insulation layer and in the substrate. This may achieve that a movement of the mounting tool 6 in the direction of the substrate leads to a similar movement of the anchor bolt.

The mounting tool 6 and the anchor bolt 2 can also be rotated in the direction of the substrate, that is into the borehole. For example, a rotary movement can be exerted on the mounting tool 6. In a preferred embodiment, the mounting tool 6 and the anchor bolt 2 are configured in such a way that they can be arranged together in a rotationally fixed manner, that is a rotational movement of one element is transferred to the other element. This means that when the mounting tool 6 is rotated into the borehole, the anchor bolt 2 is also rotated into the borehole.

The fastening system 1 according to the invention also has a sealing element 7. The sealing element 7 is configured in such a way that it can seal the opening in the insulation layer formed by the mounting tool 6. For this purpose, the sealing element is arranged at the stop 5.

In the embodiment of the present invention illustrated in FIG. 1, the sealing element 7 comprises a metal washer 7*a*, preferably made of stainless steel, and a circular sealing member 7*b*.

FIGS. 2*a*-2*e* illustrate the various steps involved in installing the embodiment of the fastening system 1 according to the invention shown in FIG. 1. The wall to which the attachment is to be fastened has a substrate 13 and a layer of insulation material 14. In the example shown here, a plaster layer 15 is arranged on the layer of insulation material 14. In the present invention, the layers above the substrate 13 are referred to as insulation layer 16, irrespective of how many layers that layer consists of and whether it has layers which are not mainly used for insulation, such as plaster layer 15.

A hole was drilled into the insulation layer 16 and into the substrate 13 and an adhesive was introduced into the hole. FIG. 2*a* shows how the anchor bolt 2 and the mounting tool 6—together in this example—are arranged in the borehole. As already explained above, in this embodiment the anchor bolt 2 and the mounting tool 6 are arranged in a torque proof manner. Thus a tool can be arranged on the mounting tool 6 with which the mounting tool 6 and the anchor bolt 2 arranged on it can be driven into the borehole in rotation. For this purpose, the mounting tool 6 can have a corresponding tool holder, for example an external hexagon. In principle, however, the mounting tool 6 can also be arranged without tools, for example directly in the borehole by the person installing the fastening system. For this purpose, the mounting tool can, for example, have a corresponding grip surface.

The rotating driving of anchor bolt 2 and mounting tool 6 ensures that anchor bolt 2 can be well placed in the substrate 13 and that the mounting tool 6 can form the opening in the insulation layer 16. The anchor bolt 2 and the mounting tool 6 are driven into the insulation layer 16 and into the substrate 13 until the projection 11 rests on the side of the insulation layer 16 facing away from the substrate. This ensures that the anchor bolt 2 is as deep as necessary in the substrate 13. It is also ensured that the mounting tool 6 forms the opening in the insulation layer 16 to the desired depth. In addition, the mounting tool 6 ensures that the anchor bolt 2 is fixed radially in the opening at a position determined by the geometry of the mounting tool 6 and that the stop 5 of the anchor bolt 2 is axially located at a position determined by the arrangement of the projection 11 relative to the counter stop 5*a*. The mounting tool 6 remains in this position as shown in FIG. 2*b*, preferably until the anchor bolt 2 is held firmly in this position. If anchor bolt 2 is fixed with an adhesive, this period may depend on the adhesive used.

Afterwards, the mounting tool 6 is removed from the anchor bolt 2 (see FIG. 2*c*). The desired opening then remains in the insulation layer 16, which in this example extends concentrically around the anchor bolt 2. This annular gap ensures that deformations of anchor bolt 2 under service load are absorbed without constraint.

As shown in FIG. 2*d*, the sealing element 7 is then arranged on the installed anchor bolt 2. In this example, the sealing element 7 is fastened to the external thread of the second area 4 of the anchor bolt 2 with a nut 17 and an attachment 18. In this embodiment, the attachment 18 is fastened to the anchor bolt 3 as a clamping part between the washer 7*a* of the sealing element 7 and the nut 17. Due to the fixed axial position of the stop 5 relative to the outer surface of the insulation layer 16, the sealing element 7 arranged at the stop of the anchor bolt 2 is preferably compressed with the nut 17 against the stop 5 and against the outer surface of the insulation layer 16 in order to achieve the best possible sealing effect.

FIG. 2*e* shows that the sealing element 7, when installed, rests at least partially on the outer surface of the insulation layer 16. This allows the opening in the insulation layer 16 to be effectively sealed. The sealing element 7 is located above the opening and thus prevents moisture from entering into the opening. The sealing element 7 rests on the edge of the opening on the insulation layer 16 and thus seals this area. The sealing element 7 is so large, that is it extends so far into the plane of the insulation layer 16 that it covers the opening in the insulation layer 16 even when the anchor bolt 7 and the associated sealing element 7 move.

What is claimed is:

1. Fastening system (1) for fastening an attachment (18) to a substrate (13) with an insulation layer (16), the fastening system (1) comprising:

an anchor bolt (2), with a first area (3) for anchoring in the substrate (13), a second area (4) to which the attachment (18) can be fastened, and a stop (5), a mounting tool (6) configured to directly contact the insulation layer so as to remove or expand the insulation layer (16) around the anchor bolt (2) by arranging the mounting tool (6) on the anchor bolt (2) to form an opening in the insulation layer (16), and a sealing element (7) adapted to be disposed at the stop (5) after the mounting tool (6) has been removed and to seal the opening in the insulation layer (16).

2. The fastening system (1) according to claim 1, wherein the anchor bolt (2) comprises a plastic rod (8) in the first area (3) and a metal rod (9) in the second area (4).

3. The fastening system (1) according to claim 2, wherein the metal rod (9) has an external thread.

4. The fastening system (1) according to claim 1, wherein the anchor bolt (2) is configured such that in an assembled state at least a part of the anchor bolt (2) projects from the insulation layer.

5. The fastening system (1) according to claim 1, wherein the mounting tool (6) comprises at least one means (10) for removing the insulation layer (16) around the anchor bolt (2) when the mounting tool (6) is rotatably inserted.

6. The fastening system (1) according to claim 1, wherein the mounting tool (6) has at least one projection (11) for resting on the side of the insulation layer (16) facing away from the substrate (13).

7. The fastening system (1) according to claim 1, wherein the sealing element (7) is configured such that, in an assembled state, it rests on the side of the insulation layer (16) facing away from the substrate (13).

8. A method for fastening an attachment (18) to a substrate (13) having an insulation layer (16), comprising the steps of:

inserting an anchor bolt (2) into a borehole in the insulation layer (16) and in the substrate (13);

arranging a mounting tool (6) on the anchor bolt (2), inserting the mounting tool (6) into the insulation layer (16), wherein the mounting tool (6) is configured to directly contact the insulation layer so as to remove or expand the insulation layer (16) around the anchor bolt (2) to form an opening in the insulation layer (16), and removing the mounting tool (6) and arranging a sealing element (7) at a stop (5) of the anchor bolt (2) to seal the opening in the insulation layer (16).

* * * * *